US007027749B2

(12) United States Patent
Kamei

(10) Patent No.: US 7,027,749 B2
(45) Date of Patent: Apr. 11, 2006

(54) FIXING DEVICE AND IMAGE FORMING APPARATUS

(75) Inventor: Chikashi Kamei, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 92 days.

(21) Appl. No.: 10/784,165

(22) Filed: Feb. 24, 2004

(65) Prior Publication Data

US 2005/0185977 A1 Aug. 25, 2005

(51) Int. Cl.
*G03G 15/20* (2006.01)

(52) U.S. Cl. ..... 399/69; 399/330

(58) Field of Classification Search ..... 399/33, 399/67, 69, 70, 96, 328, 330
See application file for complete search history.

(56) References Cited

U.S. PATENT DOCUMENTS 6,775,491 B1 * 8/2004 Akutsu et al. ..... 399/69
6,889,018 B1 * 5/2005 Kinouchi et al. ..... 399/69

FOREIGN PATENT DOCUMENTS

JP 2002-221872 A 8/2002

* cited by examiner

*Primary Examiner*—David M. Gray
*Assistant Examiner*—Ryan D. Walsh
(74) *Attorney, Agent, or Firm*—Foley & Lardner LLP

(57) ABSTRACT

A center thermostat (16) corresponding to a center heater in a heat roller (10) and a side thermostat (17) corresponding to a side heater in the heat roller (10) are so installed that the distances to the center heater (11) and side heater (12) are equal in the diameter direction of the heat roller (10).

7 Claims, 5 Drawing Sheets

FIXING DEVICE AND IMAGE FORMING APPARATUS

BACKGROUND OF THE INVENTION

1. Field of the Invention

The present invention relates to a fixing apparatus and image forming apparatus by which a toner image transferred onto a paper sheet by an electrophotographic process or the like is fixed on the sheet.

2. Description of the Related Art

Recently, many fixing devices have a plurality heater lamps in a heat roller. In such a fixing device having a heat roller containing a plurality of heater lamps, thermostats are installed in one-to-one correspondence with these heater lamps in order to prevent inconveniences caused by abnormal lightning of the heater lamps.

Also, some conventional fixing devices use a plurality of different types of thermostats having different operating temperatures corresponding to predetermined installation positions on the surface of the heat roller. In a fixing device like this, each thermostat must be correctly identified and installed in a predetermined position. For example, when a plurality of thermostats having the same shape but different in operating temperature are to be installed, each thermostat may be attached to a wrong position because all the thermostats have the same shape. To solve this problem, each thermostat having undergone processing such as marking for correctly identifying it is installed in a predetermined position. Unfortunately, in the fixing device as described above, this processing of marking each thermostat increases the number of thermostat mounting steps, thereby increasing the cost of the fixing device.

BRIEF SUMMARY OF THE INVENTION

It is an object of the present invention to provide an inexpensive fixing device by using a plurality of identical thermostats for protection against abnormal lightning of a plurality of heater lamps built to a heat roller, and to provide a fixing device and image forming apparatus capable of making a thermostat mounting operation easy and reliable.

A fixing device of the present invention comprises a substantially cylindrical heat roller which is used to fix toner on a paper sheet, a center heater which is placed, inside the heat roller, in a position above a central position in a diameter direction of the heat roller, in a center region in a longitudinal direction of the heat roller, a pair of side heaters which are placed, inside the heat roller, in positions below the central position in the diameter direction of the heat roller, in side regions in the longitudinal direction of the heat roller, a first power shutoff unit which is installed in a position corresponding to the center heater in the longitudinal direction of the heat roller, on a heat roller surface where distances to the center heater and side heater are equal in the diameter direction of the heat roller, and which shuts off power supply to the center heater and side heaters when a surface temperature of the heat roller in the installation position has reached a predetermined operating temperature, and a second power shutoff unit which is installed in a position corresponding to one of the side heaters in the longitudinal direction of the heat roller, on a heat roller surface where distances to the center heater and side heater are equal in the diameter direction of the heat roller, and which shuts off power supply to the center heater and side heaters when the surface temperature of the heat roller in the installation position has reached the same operating temperature as the first thermostat.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention and, together with the general description given above and the detailed description of the preferred embodiments given below, serve to explain the principles of the invention.

FIG. 4 is a flowchart showing control of preventing overheating when the power supply is turned on;

FIG. 6 is a timing chart showing the sequence of temperature control when the power supply is turned on;

DETAILED DESCRIPTION OF THE INVENTION

An embodiment of the present invention will be described below with reference to the accompanying drawing.

Figure 1:
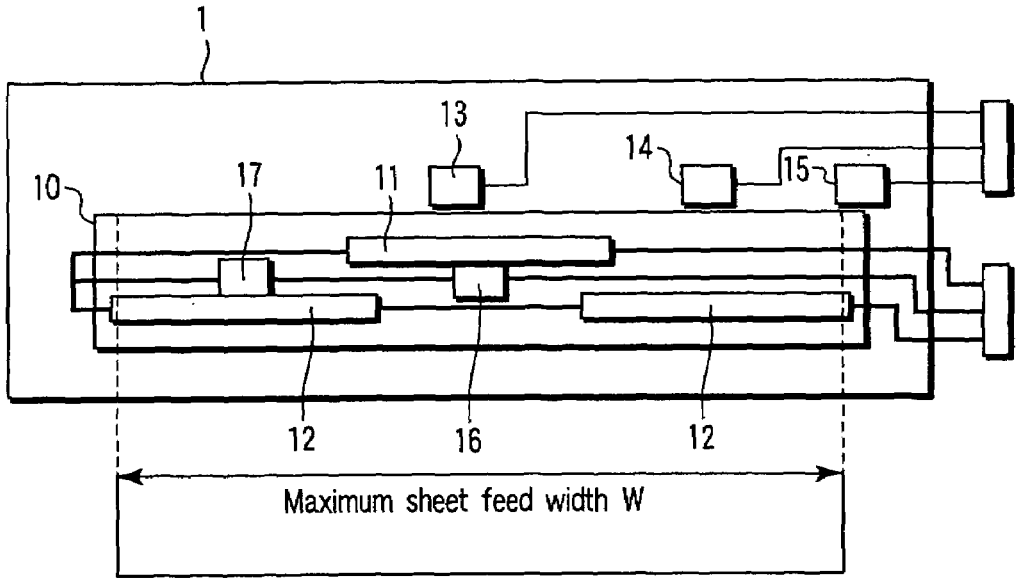
FIG. 1 is a view schematically showing the structure of a fixing device according to an embodiment of the present invention.

FIG. 1 is a sectional view for explaining an outline of the major components of a fixing device 1 according to an embodiment of the present invention.

The fixing device 1 is used in an image forming apparatus such as a well-known digital multifunction apparatus which forms images by an electrophotographic method.

As shown in FIG. 1, a heat roller 10 as a heating member of the fixing device 1 contains a center heater lamp (to be referred to as a center heater hereinafter) 11 and side heater lamps (to be referred to as side heaters hereinafter) 12 for heating the heat roller 10.

For example, the center heater 11 is a heater lamp having a 600-W heater filament, and each side heater 12 is a heater lamp having a 300-W heater filament. These filaments used in the center heater 11 and side heaters 12 have the same length.

The center heater 11 has heat distribution characteristics with which a central portion (to be referred to as a center portion hereinafter) in the longitudinal direction of the heat roller 10 is primarily heated. The side heaters 12 have heat distribution characteristics with which two end portions (to be referred to as side portions hereinafter) in the longitudinal direction of the heat roller 10 are primarily heated. These heat distribution characteristics of the center heater 11 and side heaters 12 are so designed as to be flat on the surface of the heat roller 10.

In the following explanation, a central portion (a region corresponding to the center heater 11) in the longitudinal direction of the heat roller 10 will be referred to as a center region, and two end portions (regions corresponding to the side heaters 12) in the longitudinal direction of the heat roller 10 will be referred to as side regions.

In the fixing device 1, the total electrical energy of the center heater 11 and side heaters 12 is so designed as to be substantially equal to the electrical energy which can be supplied when the power supply of the digital multifunction apparatus using the fixing device 1 is turned on. Also, the electrical energy of the center heat 11 and that of the side heaters 12 are set equal to each other.

A maximum sheet feed width W shown in FIG. 1 is set to a predetermined width (the width of a maximum-size sheet) on the basis of the central position in the longitudinal direction of the heat roller 10. That is, the maximum sheet feed width W indicates a width by which the heat roller 10 can fix an image transferred onto a paper sheet. The maximum sheet feed width W is set shorter than the length in the longitudinal direction of the heat roller 10. Accordingly, non-sheet-feed portions are formed outside the maximum sheet feed width W of the heat roller 10.

In the center region in the longitudinal direction of the heat roller 10, a thermistor (to be referred to as a center thermistor hereinafter) 13 as a first temperature detecting means for detecting the surface temperature of the heat roller 10 heated by the center heater 11 is installed. In the side region in the longitudinal direction of the heat roller 10, a thermistor (to be referred to as a side thermistor hereinafter) 14 as a second temperature detecting means for detecting the surface temperature of the heat roller 10 heated by the side heater 12 is installed. In addition, in the non-sheet-feed portion in the longitudinal direction of the heat roller 10, a thermistor (to be referred to as an edge thermistor hereinafter) 15 as a third temperature detecting means for detecting the temperature of the non-sheet-feed portion is installed.

In the central position (the central position in the longitudinal direction of the heat roller 10) of the center region, a center thermostat 16 as a first power shutoff unit is installed. In the central position of the side region, a side thermostat 17 as a second power shutoff unit is installed. When an excessively high temperature (a predetermined device protection temperature) is reached, the thermostats 16 and 17 protect the fixing device 1 by shutting off power supply to the center heater 11 and side heaters 12.

Figure 2:
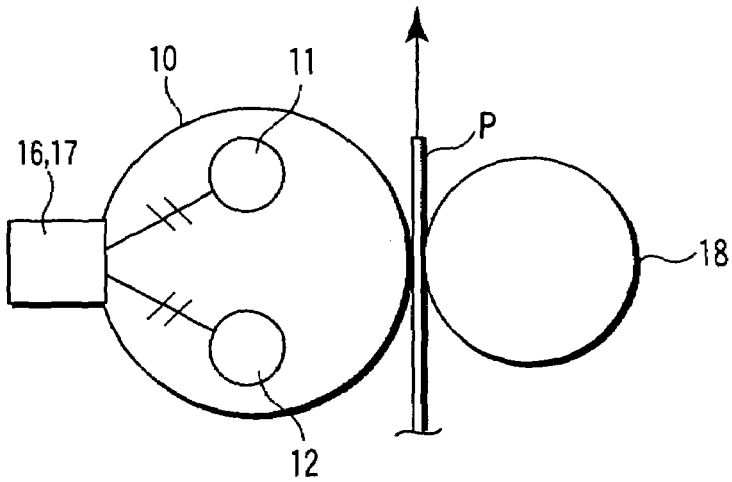
FIG. 2 is a sectional view showing the structure of a heat roller and its vicinity in the fixing device.

FIG. 2 is a sectional view showing an arrangement around the heat roller 10.

As shown in FIG. 2, the heat roller 10 and a press roller 18 feed a sheet P, on to which toner is transferred, in a direction indicated by the arrow in FIG. 2, and perform a fixing process. Heat from the heat roller 10 and the pressure between the heat roller 10 and press roller 18 are applied to the sheet P. As a consequence, the toner is fixed to the sheet P.

The heat roller 10 contains the center heater 11 and side heaters 12. The center heater 11 is positioned above (in the first direction) the center in the diameter direction of the heat roller 10. The side heaters 12 are positioned below (in the second direction) the center in the diameter direction of the heat roller 10.

In addition, as shown in FIG. 2, the thermostats 16 and 17 are installed at equal distances to the center heater 11 and side heater 12 in the diameter direction of the heat roller 10.

That is, in the center region (the central position of the center heater 11) in the longitudinal direction of the heat roller 10, the thermostat 16 is placed on the surface of the heat roller 10 where the distances to the center heater 11 and side heater 12 are equal in the diameter direction of the heat roller 10. Likewise, in the side region (the central position of the side heater 12) in the longitudinal direction of the heat roller 10, the thermostat 17 is placed on the surface of the heat roller 10 where the distances to the center heater 11 and side heater 12 are equal in the diameter direction of the heat roller 10.

The thermostats 16 and 17 are safety devices for forcibly shutting off power supply to the center heater 11 and side heaters 12 if the heat roller 10 is abnormally heated by, e.g., abnormal lightning of the center heater 11 and side heaters 12.

For this purpose, the thermostats 16 and 17 must be placed in optimum positions with respect to the heat roller 10. As described above, the center heater 11 is positioned above the center in the diameter direction of the heat roller 10; the center heater 11 is positioned near the upper side of the heat roller 10. The side heaters 12 are positioned below the center in the diameter direction of the heat roller 10; the side heaters 12 are positioned near the lower side of the heat roller 10. Therefore, if abnormal lightning of the center heater 11 occurs, the upper side of the heat roller 10 often reaches an abnormal temperature faster than the lower side. If abnormal lightning of the side heaters 12 occurs, the lower side of the heat roller 10 often reaches an abnormal temperature faster than the upper side.

Accordingly, as shown in FIG. 2, the thermostats 16 and 17 are arranged at equal distances to the center heater 11 and side heater 12 in the diameter direction of the heat roller 10.

The configuration of a control system of the fixing device 1 will be explained below.

Figure 3:
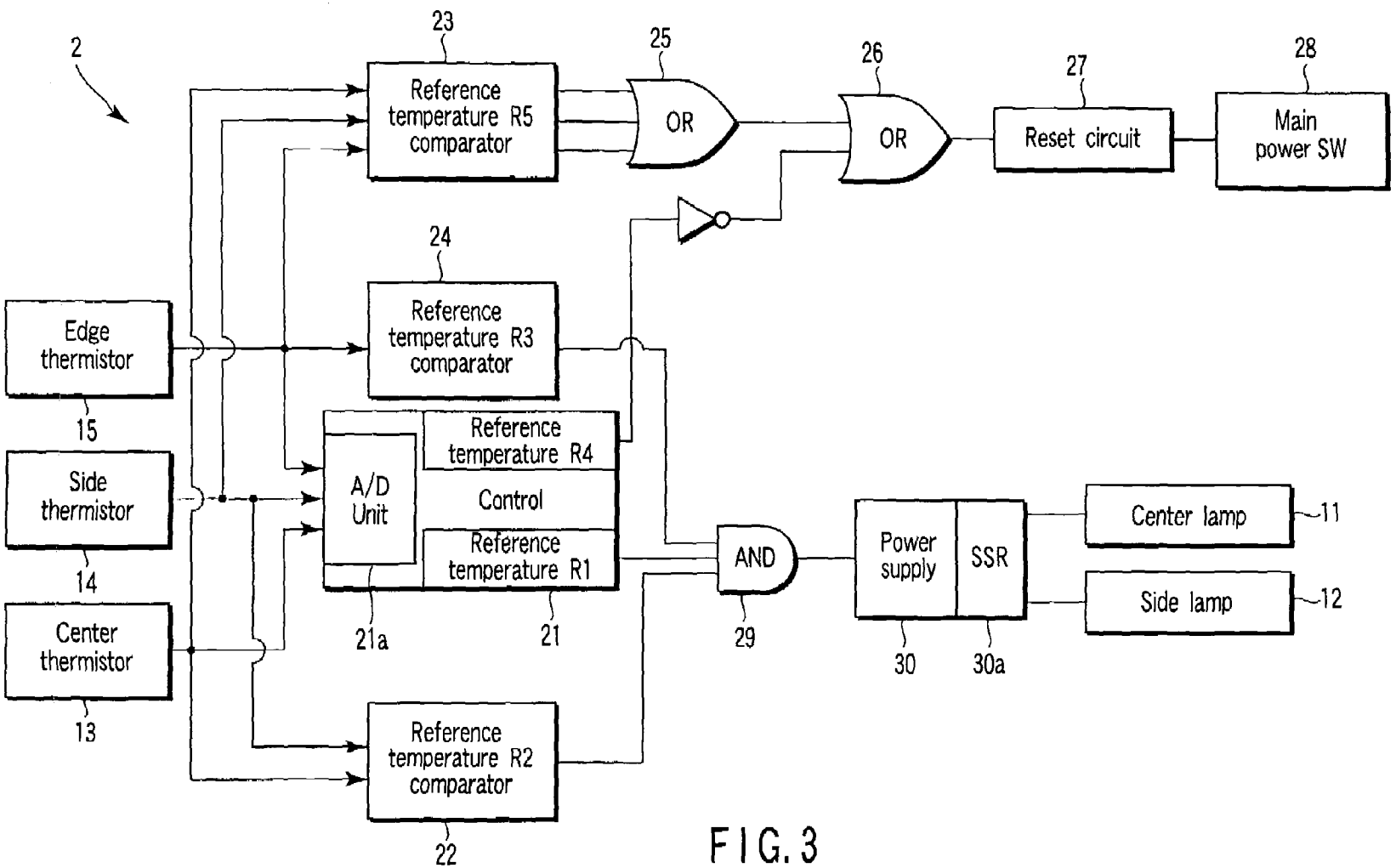
FIG. 3 is a block diagram showing the configuration of a control mechanism of the fixing device.

FIG. 3 is a block diagram showing the configuration of the control system for the heater lamps (center heater 11 and side heaters 12) of the fixing device 1.

As shown in FIG. 3, outputs from the center thermistor 13 and side thermistor 14 are input to a controller 21, reference temperature R2 comparator 22, and reference temperature R5 comparator 23. An output from the edge thermistor 15 is input to the controller 21, a reference temperature R3 comparator 24, and the reference temperature R5 comparator 23.

The controller 21 comprises an A/D unit 21*a*, CPU (not shown), ROM (not shown), storage unit (not shown), timer (not shown), and the like. For example, the controller 21 comprehensively controls the digital multifunction apparatus using the fixing device 1. The CPU executes various processes on the basis of control programs stored in the ROM and various settings stored in the storage unit. The timer generates time information. The CPU counts time by this timer. The ROM stores, e.g., a reference temperature (fixing control temperature) R1, a reference temperature (first protection control temperature) R4, and the various control programs to be executed by the CPU. The storage unit stores various preset times (to be described later) and the like. The A/D unit 21*a* converts analog signals indicating temperatures detected by the center thermistor 13, side thermistor 14, and edge thermistor 15 into digital signals.

The control programs include a control program for comparing the temperatures, detected by the center thermistor 13, side thermistor 14, and edge thermistor 15 and converted into digital signals by the A/D unit 21*a*, with the reference temperatures R1 and R4.

For example, on the basis of this control program, the CPU of the controller 21 compares the temperatures detected by the thermistors 13, 14, and 15 with the reference temperature R1. If all the detection temperatures of the thermistors 13, 14, and 15 fall within the range of the reference temperature R1, the CPU outputs an output signal "1" to an AND gate 29. If even one of the detection temperatures of the thermistors 13, 14, and 15 falls outside the range of the reference temperature R1, the CPU outputs an output signal "0" to the AND gate 29.

Also, on the basis of the above control program, the CPU of the controller 21 compares the temperatures detected by the thermistors 13, 14, and 15 with the reference temperature R4. If all the detection temperatures of the thermistors 13, 14, and 15 fall within the range of the reference temperature R4, the CPU outputs an output signal "1" to an OR gate 26. If even one of the detection temperatures of the thermistors 13, 14, and 15 falls outside the range of the reference temperature R4, the CPU outputs an output signal "0" to the OR gate 26.

The reference temperature R2 comparator 22 compares output signals from the center thermistor 13 and side thermistor 14 with a reference temperature (fixing control temperature) R2. If the output signals from the center thermistor 13 and side thermistor 14 fall within the range of the reference temperature R2, the reference temperature R2 comparator 22 outputs an output signal "1" to the AND gate 29. If the output signals from the center thermistor 13 and side thermistor 14 fall outside the range of the reference temperature R2, the reference temperature R2 comparator 22 outputs an output signal "0" to the AND gate 29.

The reference temperature R3 comparator 24 compares an output signal from the edge thermistor 15 with a reference temperature R3. If the output signal from the edge thermistor 15 falls within the range of the reference temperature R3, the reference temperature R3 comparator 24 outputs an output signal "1" to the AND gate 29. If the output signal from the edge thermistor 15 falls outside the range of the reference temperature R3, the reference temperature R3 comparator 24 outputs an output signal "0" to the AND gate 29.

The AND gate 29 ANDs the output from the controller 21 and the outputs from the reference temperature R2 comparator 22 and reference temperature R3 comparator 24. For example, if the detection temperatures of the center thermistor 13 and side thermistor 14 fall within the ranges of the reference temperatures R1 and R2 and the detection temperature of the edge thermistor 15 falls within the range of the reference temperature R3, the AND gate 29 outputs an output signal "1" to a power supply 30.

The power supply 30 supplies power to the center heater 11 and side heaters 12. The power supply 30 contains an SSR (Solid-State Relay) 30*a*. For example, when "1" is input from the AND gate 29, the power supply 30 supplies power to the center heater 11 and side heaters 12.

The reference temperature R5 comparator 23 compares the temperature signals (the temperatures detected by the center thermistor 13, side thermistor 14, and edge thermistor 15) output from the center thermistor 13, side thermistor 14, and edge thermistor 15 with a reference temperature (second protection control temperature) R5. The comparison results are output, to an OR gate 25, as three output signals corresponding to the thermistors 13, 14, and 15.

For example, if the temperature detected by the center thermistor 13 (or the side thermistor 14 or edge thermistor 15) exceeds the range of the reference temperature R5, the reference temperature R5 comparator 23 outputs a corresponding output signal as "1" to the OR gate 25. If the temperature detected by the center thermistor 13 (or the side thermistor 14 or edge thermistor 15) falls within the range of the reference temperature R5, the reference temperature R5 comparator 23 outputs a corresponding output signal as "0" to the OR gate 25.

The OR gate 25 ORs the three output signals from the reference temperature R5 comparator 23. The OR gate 25 outputs the result to the OR gate 26. The OR gate 26 ORs the output from the controller 21 and the output from the reference temperature R5 comparator 23. If one of the outputs from the controller 1 and reference temperature R5 comparator 23 is "1", the OR gate 26 outputs an output signal "1" to a reset circuit 27.

The reset circuit 27 is a circuit for shutting off the electric power supplied when a main power SW 28 is turned on. When "1" is output from the OR gate 26, the reset circuit 27 resets the power supply of the digital multifunction apparatus to OFF.

The operation of the control system of the fixing device 1 configured as above will be explained below.

Figure 4:
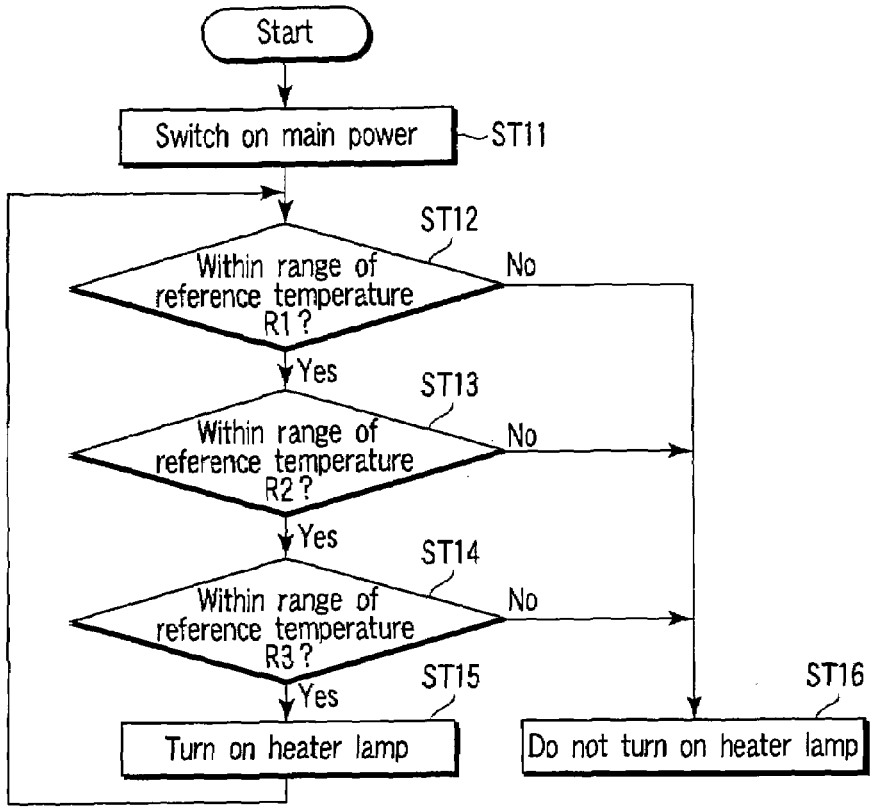

FIG. 4 is a flowchart for explaining a control operation of preventing overheating when the power supply of the digital multifunction apparatus using the fixing device 1 is turned on (when the apparatus is warmed up).

That is, as shown in FIG. 4, after the main power switch (SW) 28 is turned on (step ST11), the center heater 11 and side heaters 12 can be turned on (step ST15) if the detection temperatures of the center thermistor 13 and side thermistor 14 fall within the range of the reference temperature R1 in the controller 21 (YES in step ST12), the detection temperatures of the center thermistor 13 and side thermistor 14 fall within the range of the reference temperature R2 (YES in step ST13), and the detection temperature of the edge thermistor 15 falls within the range of the reference temperature R3 (YES in step ST14), i.e., if all these conditions are met.

If the detection temperatures of the center thermistor 13 and side thermistor 14 are the reference temperature R1 (NO in step ST12), if the detection temperatures of the center thermistor 13 and side thermistor 14 fall outside the range the reference temperature R2 (NO in step ST13), or if the detection temperature of the edge thermistor 15 falls outside the reference temperature R3 (YES in step ST14), the center heater 11 and side heaters 12 cannot be turned on (step ST16).

Figure 5:
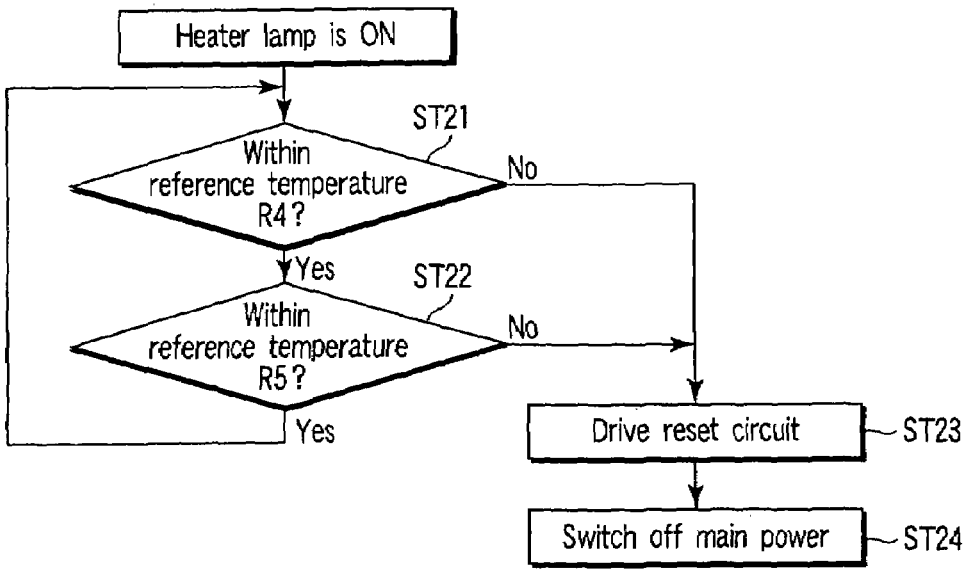
FIG. 5 is a flowchart showing control of preventing overheating in a standby state and printing state.

FIG. 5 is a flow chart for explaining control operation of preventing overheating during heater lamp lightning control of the fixing device 1 (i.e., in a standby state and printing state of the digital multifunction apparatus using the fixing device 1). That is, FIG. 5 is a flow chart for explaining a control operation of protecting the device on the basis of the temperatures detected by the thermistors 13, 14, and 15.

More specifically, as shown in FIG. 5, if the detection temperature of the edge thermistor 15 exceeds the reference temperature R4 in the controller 21 (NO in step ST21), of if the detection temperature of any of the center thermistor 13, side thermistor 14, and edge thermistor 15 exceeds the reference temperature R5 (NO in step S22), the output signal "1" from the OR gate 25 or controller 21 is input to the OR gate 26. In this case, the OR gate 26 outputs an output signal "1" to the reset circuit 27. Consequently, the reset circuit 27 is driven (step ST23) to switch off the power supply of the digital multifunction apparatus (step ST24).

The control executed by the controller 21 in the fixing device 1 having the protection control against overheating as described above will be explained below with reference to FIGS. 6 and 7.

In this embodiment, an operation by which the controller 21 controls the center heater 11 and side heaters 12 to a predetermined temperature will be described.

The controller 21 has a function of controlling the SSR 30*a* of the power supply 30. That is, by controlling the power supply 30, the controller 21 can on/off control the center heater 11 and side heaters 12 to start and stop heating.

The internal storage unit of the controller 21 stores a control temperature for allowing the heat roller 10 to perform fixing. In addition, a control temperature range is set as upper- and lower-limiting margins of the control temperature in the internal storage unit of the controller 21. For example, the control temperature range is so set that the control temperature +2° C. is a lamp-off temperature and the control temperature −2° C. is a lamp-on temperature.

Figure 6:
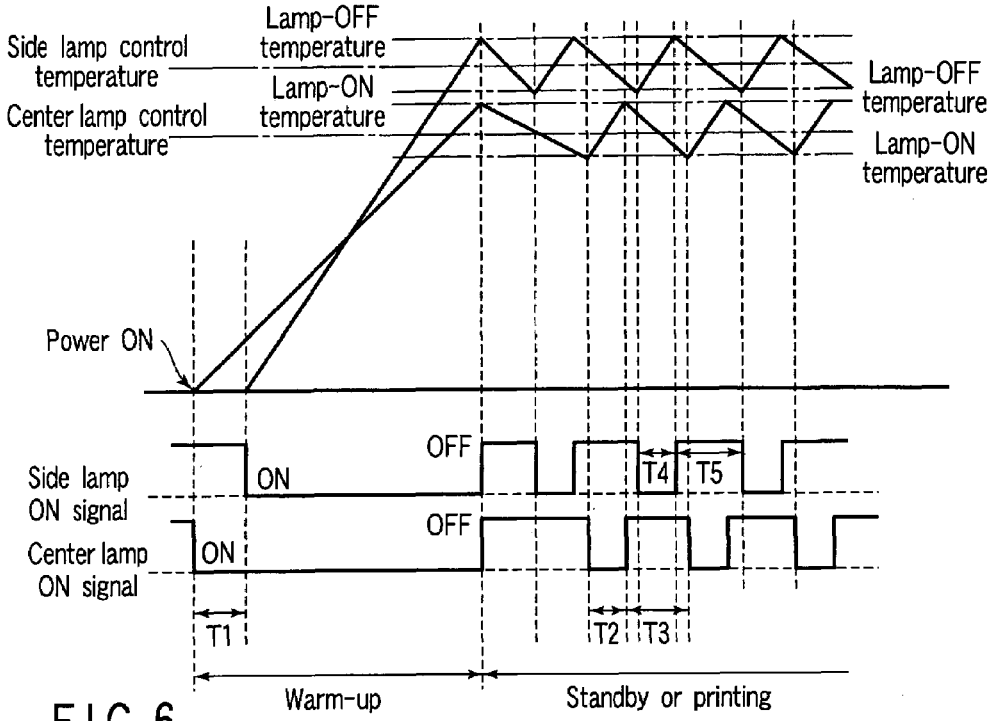

FIG. 6 is a timing chart for explaining the sequence of temperature control when the digital copying machine using the fixing device 1 is warmed up.

First, when an operator turns on the main power SW 28, as shown in FIG. 6, the controller 21 starts warming up the digital multifunction apparatus. In this warm-up, the controller 21 starts heating the center heater 11. Additionally, when a lamp-on delay time T1 has elapsed from the heating start timing of the center heater 11, the controller 21 performs control for starting heating of the side heaters 12. The lamp-on delay time T1 is preset in the storage unit of the controller 21.

If temperatures detected by the center thermistor 13 and side thermistor 14 exceed the control temperature range, the controller 21 stops heating the center heater 11 and side heaters 12. When this warm-up is complete, the digital copying machine is set in a printable state.

In this printable state, the controller 21 compares the detection results of the thermistors 13, 14, and 15 with the control temperature range, and outputs a lamp-on signal to the SSR 30*a* of the power supply 30 in accordance with the comparison result. If the center heater 11 or side heaters 12 are lit to perform heating, the controller 21 delays the start of heating of the other heater to maintain the surface temperature of the heat roller 10 in the control temperature range.

To maintain the surface temperature of the heat roller 10 in the control temperature range, the controller 21 performs the following control.

If the temperature detected by the center thermistor 13 becomes equal to or lower than the lamp-on temperature, the controller 21 starts heating the center heater 11. After starting this heating, the controller 21 counts a maximum ON time T2 (first time setting means) which is the first time, stored in the storage unit, during which heating of the center heater 11 is continued. If the detection temperature of the center thermistor 13 exceeds the lamp-off temperature or if the maximum ON time has elapsed, the controller 21 stops heating the center heater 11. After stopping this heating, the controller 21 counts a minimum OFF time T3, stored in the storage unit, during which the start of heating of the center heater 11 is stopped.

Also, if the temperature detected by the side thermistor 14 becomes equal to or lower than the lamp-on temperature, the controller 21 starts heating the side heaters 12. After starting this heating, the controller 21 counts a maximum ON time T4 which is the second time, stored in the storage unit, during which heating of the side heaters 12 is continued. If the detection temperature of the side thermistor 14 exceeds the lamp-off temperature or if the maximum ON time has elapsed, the controller 21 stops heating the side heaters 12. After stopping this heating, the controller 21 counts a minimum OFF time T5, stored in the storage unit, during which the start of heating of the side heaters 12 is stopped.

As described above, the minimum OFF times T3 and T5 are counted after heating of the center heater 11 and side heaters 12 is stopped in order to prevent continuous heating by only either the center heater 11 or side heaters 12.

Also, since the heating control of the center heater 11 and side heaters 12 is performed as described above, the center heater 11 and side heaters 12 do not simultaneously heat. However, the center heater 11 and side heaters 12 can simultaneously stop heating. An example is a case in which after one heater lamp has reached the lamp-off temperature by heating, the other heater lamp starts heating and reaches the lamp-off temperature before the former heater lamp cools to the lamp-on temperature. Accordingly, if no heating is necessary, the controller 21 does not heat either the center heater 11 or side heaters 12.

Figure 7:
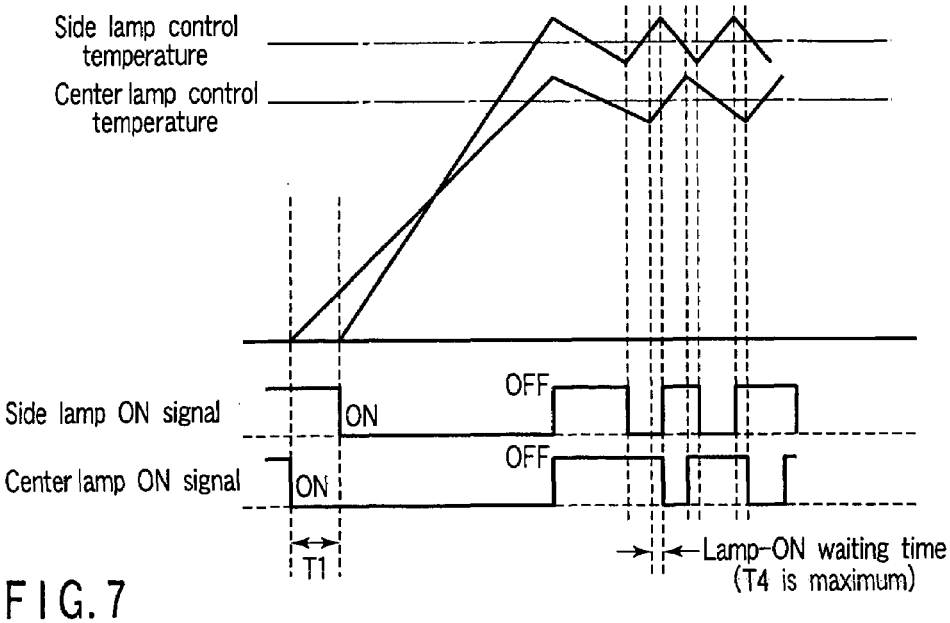
FIG. 7 is a timing chart showing the sequence of temperature control.

FIG. 7 is a timing chart for explaining the sequence of temperature control in the digital copying machine using the fixing device 1.

As shown in FIG. 7, even when requested to start heating the center heater 11 while the side heaters 12 are heated, the controller 21 keeps the start of heating of the center heater 11 waiting for a time indicated by a lamp-on waiting time in FIG. 7 until heating of the side heaters 12 stops. When heating of the side heaters 12 stops, the controller 21 starts heating the center heater 11. This lamp-on waiting time is a maximum when the start of heating of the center heater 11 is requested immediately after heating of the side heaters 12 is started. This is a maximum ON time T4.

Note that when the start of heating of the side heaters 12 is requested while the center heater 11 is heated, the start of heating of the side heaters 12 is kept waiting until heating of the center heater 11 stops. In this case, the maximum lamp-on waiting time is a maximum ON time T2.

The lamp-on delay time T1, maximum ON times T2 and T4, and minimum OFF times T3 and T5 are stored in the storage unit of the controller 21. As these values, an operator can set any arbitrary values by software by operating an operation unit or the like of the digital multifunction apparatus.

The maximum ON times T2 and T4 are set longer than a time during which the surface temperature of the heat roller 10 can be raised from the lamp-on temperature to the lamp-off temperature by the center heater 11 and side heaters 12 in one cycle from the start to the stop of heating, and set to proper times in accordance with the lamp-on temperature and lamp-off temperature with respect to the electrical energies and control temperatures of the center heater 11 and side heaters 12.

That is, in the fixing device 1, while one heater lamp is heated, the start of heating of the other heater lamp is kept waiting. Therefore, if the maximum lamp-on times T2 and T4 are too long, the surface temperature of the heat roller 10, which corresponds to a portion to be heated by the waiting heater lamp largely lowers, and this can have influence on the fixing properties. On the other hand, if the maximum lamp-on times T2 and T4 are too short, not only the heat roller 10 does not reach the control temperature range, but also the number of times of on/off switching increases, and this is disadvantageous in flicker standard. Therefore, proper times must be set by taking account of these inconveniences.

In the fixing device 1 as described above, during warm-up, heating of one of the two heater lamps is started, and heating of the other heater lamp is started after a predetermined time has elapsed. Also, the two heater lamps are not simultaneously heated in a standby state and printing state, and neither of the two heater lamps is heated if no heating is necessary.

In the fixing device 1 having this arrangement, it is possible to prevent a surge current upon turning on of the power supply or in a standby state or printing state, and shorten the time before the printable temperature is reached after the power supply is turned on, thereby reducing the power consumption in the standby state or printing state.

Also, in the fixing device 1, the total electrical energy of the center heater 11 and side heaters 12 is set substantially equal to the electrical energy which can be supplied during warm-up. In this fixing device, therefore, substantially the whole electrical energy which can be supplied during warm-up can be used to heat the heat roller 10, and this can shorten the warming-up time. Consequently, in the fixing device which performs the control as described above, it is unnecessary to reduce the warming-up time by decreasing the thickness of the surface layer of the heat roller 10, and a temperature rise in the non-sheet-feed portions can be prevented.

Additionally, in the fixing device 1, the center heater 11 and side heaters 12 are controlled on the basis of the reference temperatures R1, R2, and R3, and the protection control of the fixing device 1 is performed on the basis of the reference temperatures R4 and R5.

Furthermore, the control of the center heater 11 and side heaters 12 based on the reference temperature R1 is performed by software by the controller 21, and the control of the center heater 11 and side heaters 12 based on the reference temperatures R2 and R3 is performed by hardware by using the comparators and the like. Accordingly, the center heater 11 and side heaters 12 can be controlled by both the hardware configuration and software configuration.

Also, the fixing device 1 is protected by software by the controller 21 on the basis of the reference temperature R4, and by hardware by the comparators and the like on the basis of the reference temperature R5. This enhances the safety because the protection of the fixing device 1 based on the temperatures detected by the thermistors can be performed by both the hardware configuration and software configuration.

The mounting positions of the thermostats 16 and 17 in the fixing device 1 having the structure and control mechanism as described above will be explained in detail below.

Even in the fixing device 1 having the above control mechanism, device protection by the thermostats 16 and 17 is necessary in addition to device protection based on the detection temperatures of the thermistors, in order to control abnormal lightning of the center heater 11 and side heaters 12. Also, the thermostats 16 and 17 must be installed in relation to the center heater 11 and side heater 12.

The temperature distribution of the heat roller 10 in the fixing device having the structure and control mechanism as described above will be explained below.

Figure 8:
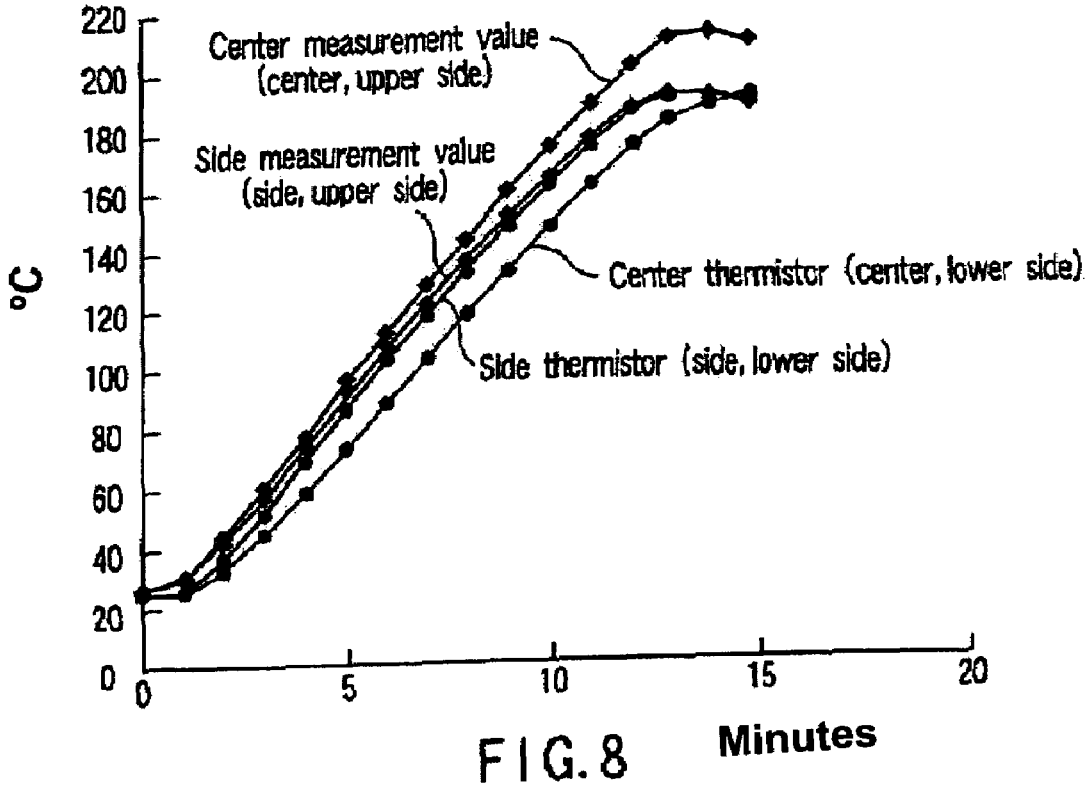
FIG. 8 is a graph showing the temperature characteristics on the heat roller.

FIG. 8 is a graph showing the characteristics of the temperatures of the upper and lower sides in the center region and the temperatures of the upper and lower sides in the side regions of the heat roller 10 of the fixing device 1 having the above structure. FIG. 8 shows the results of measurements of the temperature distribution on the surface of the heat roller 10 when the center heater 11 and side heaters 12 were simultaneously turned on as an experiment.

Figure 9:
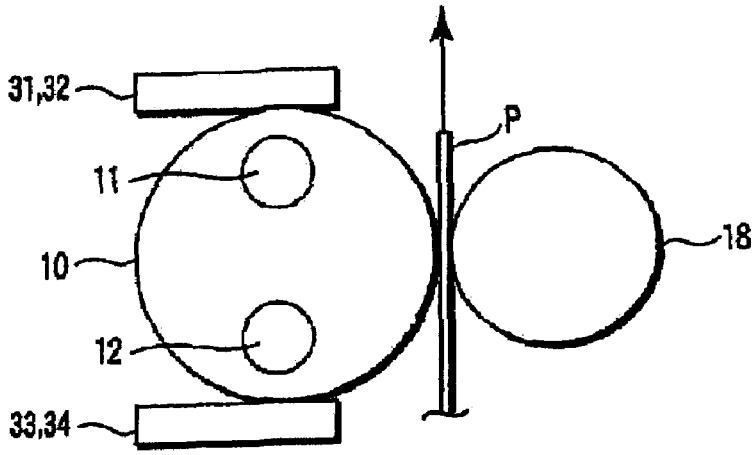
FIG. 9 is a view showing an arrangement for measuring the temperature characteristics shown in FIG. 8.

FIG. 9 shows an arrangement for detecting the temperature characteristics as shown in FIG. 8. FIG. 9 shows thermocouples 31 and 32 for detecting the temperature of the upper side in the diameter direction of the heat roller 10, and thermistors 33 and 34 for detecting the temperature of the lower side. The thermocouple 31 and thermistor 33 are arranged in the central position in the longitudinal direction of the heat roller 10, and the thermocouple 32 and thermistor 34 are arranged in the end portion (at the center of a position corresponding to the side heater) in the longitudinal direction of the heat roller 10.

In the center region in the longitudinal direction of the heat roller 10, the following relationship is obtained. As shown in FIG. 8, in the center region in the longitudinal direction of the heat roller 10, the temperature difference between the upper and lower positions in the diameter direction of the heat roller 10 is about 20° C. In the side region in the longitudinal direction of the heat roller 10, almost no temperature difference is produced between the upper and lower positions in the diameter direction of the heat roller 10.

In the upper position in the diameter direction of the heat roller 10, the temperature of the center region is higher than that of the side region. That is, as shown in FIG. 8, when measured by the thermocouples 31 and 32, the temperature in the upper position of the center region is higher than that in the upper position of the side region. Also, in the lower position in the diameter direction of the heat roller 10, the temperature of the side region is higher than that of the center region. That is, as shown in FIG. 8, when temperatures measured by the thermistors 33 and 34 are converted, the temperature in the lower position of the side region is higher than that in the lower position of the center region.

The temperature characteristics as shown in FIG. 8 described above reveal the following with regard to the installation positions of the thermostats 16 and 17.

First, in the diameter direction of the heat roller 10, an ideal installation position of the thermostats 16 and 17 is as shown in FIG. 2.

If the center thermostat 16 is placed in the upper position in the diameter direction and the side thermostat 17 is placed in the lower position in the diameter direction, the temperature in the upper position of the center becomes higher than that in the lower position of the side. Also, as described above, the positional relationship between the side and center in the upper position is opposite to that in the lower position. Therefore, an ideal installation position of the center thermostat 16 and side thermostat 17 is a position at which the distances to the center heater 11 and side heater 12 are equal, i.e., the position as shown in FIG. 2.

Furthermore, in the longitudinal direction of the heat roller 10, the positions as shown in FIG. 1 are ideal. That is, the center heater 11 and side heaters 12 are so designed that the heat distribution characteristics are flat on the surface of the heat roller 10 in the longitudinal direction of the heat roller 10. Accordingly, the centers of the individual heater lamps (i.e., the center of the center heater 11 and the center of the side heater 12) are ideal installation positions of the thermostats 16 and 17.

In the fixing device 1 in which the center heater 11 and side heaters 12 are arranged in the heat roller 10 as described above, the center thermostat 16 corresponding to the center heater in the heat roller 10 and the side thermostat 17 corresponding to the side heater in the heat roller 10 are so installed that the distances to the center heater 11 and side heater 12 are equal in the diameter direction of the heat roller 10.

In this fixing device, therefore, it is possible to use thermostats having the same operating temperature as the center thermostat and side thermostat, and to use identical parts as the center thermostat and side thermostat. As a consequence, it is possible to provide an inexpensive fixing device, and eliminate errors when these thermostats are mounted.

Additional advantages and modifications will readily occur to those skilled in the art. Therefore, the invention in its broader aspects is not limited to the specific details and representative embodiments shown and described herein. Accordingly, various modifications may be made without departing from the spirit and scope of the general inventive concept as defined by the appended claims and their equivalents.

What is claimed is:

1. A fixing device comprising:

a substantially cylindrical heat roller which is used to fix toner on a paper sheet;

a center heater which is provided inside the heat roller, spaced from a central axis of the heat roller in a first radial direction, and located in a center region in a longitudinal direction of the heat roller;

side heaters which are placed, inside the heat roller, spaced from a central axis of the heat roller in a second radial direction, and located in side regions in the longitudinal direction of the heat roller;

a first power shutoff unit which is installed in a position corresponding to the center heater in the longitudinal direction of the heat roller, on a heat roller surface where distances to the center heater and side heater are equal in the diameter direction of the heat roller, and which shuts off power supply to the center heater and side heaters when a surface temperature of the heat roller in the installation position has reached a predetermined operating temperature; and a second power shutoff unit which is installed in a position corresponding to one of the side heaters in the longitudinal direction of the heat roller, on a heat roller surface where distances to the center heater and side heater are equal in the diameter direction of the heat roller, and which shuts off power supply to the center heater and side heaters when a surface temperature of the heat roller in the installation position has reached the same operating temperature as the first power shutoff unit.

2. A fixing device according to claim 1, wherein the first power shutoff unit and second power shutoff unit comprise thermostats having the same operating characteristics.

3. A fixing device according to claim 1, which further comprises a first thermistor which detects the surface temperature of the heat roller in the center region in the longitudinal direction of the heat roller, a second thermistor which detects the surface temperature of the heat roller in the side region in the longitudinal direction of the heat roller, and a controller which controls power supply to the center heater and side heaters such that the surface temperature, detected by the first thermistor, of the center region in the longitudinal direction of the heat roller and the surface temperature, detected by the second thermistor, of the side region in the longitudinal direction of the heat roller are maintained at a fixing control temperature, and in which the operating temperature of the first power shutoff unit and second power shutoff unit is a temperature for protecting a predetermined device.

4. A fixing device according to claim 3, wherein the first power shutoff unit and second power shutoff unit comprise thermostats having the same operating characteristics.

5. A fixing device according to claim 3, further comprising:

a comparator which compares the temperature detected by the first thermistor or second thermistor with a first protection control temperature higher than the fixing control temperature and lower than the device protection temperature of the first thermistor and second thermistor; and a reset circuit which turns off a power supply of the fixing device on the basis of a signal output from the comparator and indicating that the temperature detected by the first thermistor or second thermistor is not less than the first protection control temperature, wherein the controller further compares the temperature detected by the first thermistor or second thermistor with a second protection control temperature higher than the control temperature and lower than the device protection temperature of the first thermistor and second thermistor, and controls the reset circuit to turn off the power supply of the fixing device if the temperature detected by the first thermistor or second thermistor is not less than the second protection control temperature.

6. A fixing device according to claim 5, wherein the first power shutoff unit and second power shutoff unit comprise thermostats having the same operating characteristics.

7. An image forming apparatus for forming an image on a paper sheet, comprising:

a toner image formation unit which forms a toner image on the paper sheet;

a substantially cylindrical heat roller which is used to fix the toner image, formed on the paper sheet by the toner image formation unit, on the paper sheet;

a center heater which is provided inside the heat roller, spaced from a central axis of the heat roller in a first radial direction, and located in a center region in a longitudinal direction of the heat roller;

side heaters which are placed, inside the heat roller, spaced from a central axis of the heat roller in a second radial direction, and located in side regions in the longitudinal direction of the heat roller;

a first power shutoff unit which is installed in a position corresponding to the center heater in the longitudinal direction of the heat roller, on a heat roller surface where distances to the center heater and side heater are equal in the diameter direction of the heat roller, and which shuts off power supply to the center heater and side heaters when a surface temperature of the heat roller in the installation position has reached a predetermined operating temperature; and a second power shutoff unit which is installed in a position corresponding to one of the side heaters in the longitudinal direction of the heat roller, on a heat roller surface where distances to the center heater and side heater are equal in the diameter direction of the heat roller, and which shuts off power supply to the center heater and side heaters when a surface temperature of the heat roller in the installation position has reached the same operating temperature as the first power shutoff unit.

* * * * *